US005421770A

United States Patent [19]

Bobst

[11] Patent Number: 5,421,770

[45] Date of Patent: Jun. 6, 1995

[54] DEVICE FOR GUIDING A WORKPIECE OR TOOL IN THE MACHINING OF TORIC OR SPHERICAL SURFACES OF OPTICAL LENSES ON GRINDING OR POLISHING MACHINES

[75] Inventor: Franz Bobst, Oensingen, Switzerland

[73] Assignee: Loh Engineering AG, Oensingen, Switzerland

[21] Appl. No.: 54,407

[22] Filed: Apr. 28, 1993

[30] Foreign Application Priority Data

May 1, 1992 [DE] Germany ..... 42 14 266.0

[51] Int. Cl.[6] ..... B24B 13/00

[52] U.S. Cl. ..... 451/390; 451/388; 451/162

[58] Field of Search ..... 51/216 LP, 235, 284 R, 51/165.9; 451/390, 388, 42, 24, 277, 162, 166

[56] References Cited

U.S. PATENT DOCUMENTS

| | | | |
|---|---|---|---|
| 2,880,556 | 4/1959 | Schelling | 51/124 |
| 2,916,857 | 12/1959 | Dargie | 51/124 |
| 2,977,724 | 4/1961 | Kennedy et al. | 51/124 |
| 3,886,696 | 6/1975 | Brück | 51/216 LP |
| 4,135,333 | 1/1979 | Stith | 51/160 |
| 4,653,234 | 3/1987 | Lombard | 51/216 LP |
| 4,862,644 | 9/1989 | Stith | 51/58 |

FOREIGN PATENT DOCUMENTS

| | | | |
|---|---|---|---|
| 0043233 | 1/1982 | European Pat. Off. . | |
| 0134625 | 3/1985 | European Pat. Off. . | |
| 0130991 | 3/1990 | European Pat. Off. . | |
| 2542239A1 | 8/1984 | France . | |
| 1652192 | 9/1970 | Germany . | |
| 2230357 | 1/1973 | Germany . | |
| 2252503 | 5/1974 | Germany . | |
| 2455426 | 5/1975 | Germany . | |
| 2636207 | 2/1978 | Germany . | |
| 2916592A1 | 11/1979 | Germany . | |
| 4000291A1 | 7/1991 | Germany . | |
| 60-73138 | 3/1987 | Japan . | |
| 1098765 | 6/1984 | U.S.S.R. | 51/216 LP |
| WO84/02672 | 7/1984 | WIPO . | |

*Primary Examiner*—Robert A. Rose

*Attorney, Agent, or Firm*—McAndrews, Held & Malloy, Ltd.

[57] ABSTRACT

A device is provided for guiding a workpiece or tool during the machining of toric or spherical surfaces. The device includes an axially movable spindle sleeve disposed on the grinding or polishing machine and having first and second ends. A seating chuck has support for supporting one of a lens and a tool. A connecting means is provided for fitting the chuck concentrically to the first end of the spindle support. The connecting means includes a bell-shaped flange. A ball joint connects the support means to connecting means. A roller bellows is non-resilient in the circumferential direction and connects the support means to the bell-shaped flange. The roller bellows is arranged to form a joint chamber for sealing the space in which the ball joint is situated. A pressure fluid line is connected to the joint chamber. A pressure fluid cylinder-piston assembly is disposed coaxially with the spindle sleeve and the spindle sleeve being movable with the piston. The pressure fluid spaces of the joint chamber and of the pressure fluid cylinder-piston assembly are fluidly connected so as to be charged simultaneously with pressure fluid supplied to the fluid line.

17 Claims, 3 Drawing Sheets

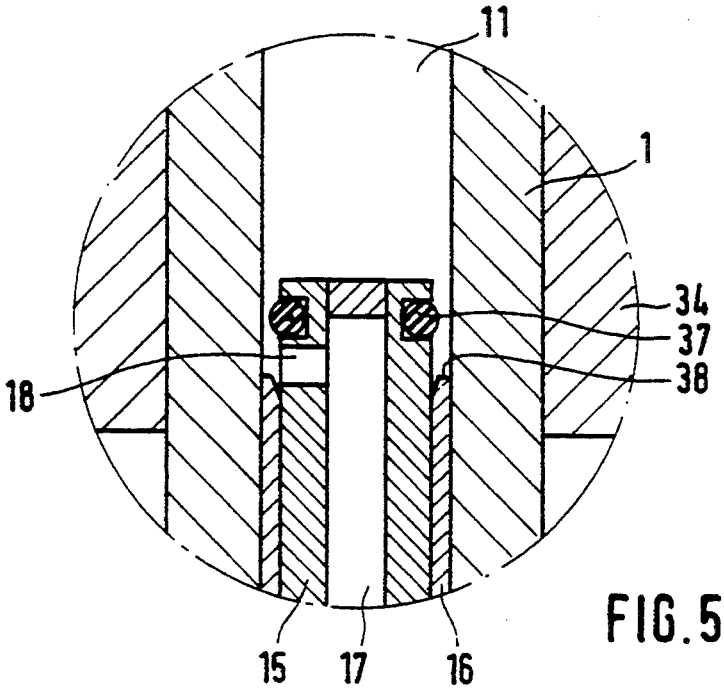
FIG. 5
FIG. 6
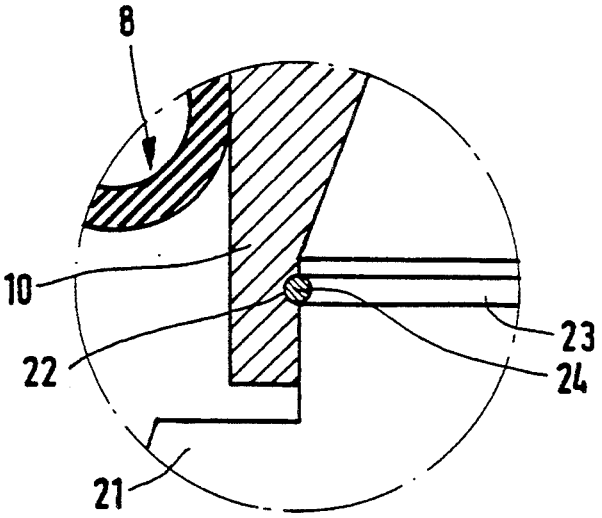

DEVICE FOR GUIDING A WORKPIECE OR TOOL IN THE MACHINING OF TORIC OR SPHERICAL SURFACES OF OPTICAL LENSES ON GRINDING OR POLISHING MACHINES

FIELD OF THE INVENTION

This invention relates to a device for guiding a workpiece or tool in the machining of toric or spherical surfaces of optical lenses on grinding or polishing machines.

BACKGROUND SECTION

Numerous machines are known for grinding and polishing optical lenses and, in particular, lenses having toric surfaces. The term toric surface may be understood as meaning a non-rotationally symmetrical, aspheric surface, which has two different radii of curvature in two mutually perpendicular sections, where the other sections represent curves of a higher order.

The finish-grinding and polishing of blanks for toric lenses is usually carried out by means of tools which have a continuous or uninterrupted, toric surface complementary to the desired lens surface. It is important, especially in the context of correcting lenses, that the two circular-arc profiles of the toric lens are mutually perpendicular. During the course of the final grinding and polishing any relative rotation between the torus axes of tool and lens must be avoided. Put another way, the two special, mutually perpendicular planes of the grinding or polishing tool, which are moved over the surface of the lens at any given point, must always remain parallel to themselves, i.e., unchanged in their orientation. Accordingly, devices for finish-grinding and polishing commonly utilize a tool in varied orbital movements, but without any rotational movement about an axis perpendicular to the toric surface.

Conventional devices for finish grinding and polishing of toric lenses typically possess a guide device and an entraining device. The guide device is intended to prevent such rotational movements and the entraining device assures a change in position of the tool relative to the lens. The-entraining device basically consists of a ball joint positioned in the axial direction in which the attack force of the tool-acts upon the lens. The ball joint deflects movements, which would otherwise cause a relative change in position between lens and tool, into a direction perpendicular to its axis. The ball joint thus makes possible a cardanic compensation between lens and tool.

A number of guide devices are known which operate on this principle. Among the known guide devices are those in which either the lens or the tool is held fixed, while the other element, that is the tool or lens, is guided by forks, drive rods and/or joints, such as ball joints. In a similar design, either the lens or the tool is caused to perform a rotational movement while the other element, that is tool or lens, is guided by a device which possesses forks, drive rods and/or joints. A problem with both of these designs is that the fork tends to an eccentric setting which inhibits complete realization of the torus.

Another problem is conventional devices for grinding and polishing typically consist of many mechanical components. Toric surfaces of good quality can be obtained using these devices, provided they are correctly adjusted. However, during operation, the components of these complicated mechanical guide devices are exposed to the abrasive grinding and polishing agents. As a result, the various components wear quickly and play develops in the joints between the components. This play arises in every type of joint, but is especially problematic in bearing and fork joints. This wear phenomena results in a change of the characteristics of the surface of the lenses produced. In particular, the relative orientation the two circular profiles of the lens can change such that the profiles are no longer be orientated perpendicularly to each other. Moreover, because considerable masses needs to be moved in conventional devices, this wear phenomena limits the relative speed between tool and workpiece and thereby results in lowering the achievable volume-time ratio and hence increasing the machining time.

Another known device includes a seating chuck equipped with either a lens support or tool support. A connecting component consists of a journal and a bell-shaped flange for fitting of the chuck. A ball joint connects the support to the connecting component. A roller bellows, non-resilient in the circumferential direction, connects the flange to the support and seals the space (joint chamber) in which the ball joint is situated. A pressure fluid line connected to the joint chamber. An axially movable spindle sleeve is disposed on the grinding or polishing machine. The seating chuck is concentrically fixed to the inner end of the spindle sleeve.

An important advance in respect of the problems indicated has been provided by a chuck for optical lenses disclosed in German Patent Specification 22 52 503. In this chuck, the orientation of the torus axes is not achieved by forks and the two conventional ball pins. Rather the chuck includes a form-fitting lens support that is guided by a roller bellows which ms non-yielding in the circumferential direction. The roller bellows presses the lens support and the lens to be machined against the tool (or vice versa) by means of an air cushion. The chuck can be concentrically fixed to the inner end of an axially movable spindle sleeve on a device such as a Loh Toro-X 2000, grinding and polishing machine as provided by the Firms Loh Optikmaschinen KG of CH-4702 Oensingen and Wilhelm Loh Wetzlar Optikmaschinen GmbH & Co KG of DE-6330 Wetzlar. Hence, the lens support is axially displaceable. Radial guidance is provided by a pin having a spherical tip about which the lens support can execute an oscillating movement which is necessary for the formfitting, homokinetic adaptation between tool and lens. The bearing pressure that acts here is transmitted via the roller bellows to the lens support. The entire chuck thus forms a homokinetic coupling, which makes possible a transmission of torques between lens support and tool without play and at the same time hermetically seals the ball joint against the abrasive polishing and grinding agents.

A major disadvantage of this device is that the spindle sleeve must be axially adjusted by hand in order to ensure correct functioning of the seating chuck.

This is especially problematic because the differing lens thicknesses and tool heights usual in machining glass to prescriptions, require that the position of the spindle sleeve must be reset each time a new lens is machined or new tool is used.

SUMMARY OF THE INVENTION

According to the invention there is provided a device for guiding a workpiece or tool in the machining of toric or spherical surfaces of optical lenses on grinding or polishing machines. The device includes an axially movable spindle sleeve disposed on the grinding or polishing machine and having first and second ends. A seating chuck has support means for supporting one of a lens and a tool. A connecting means is provided for fitting the chuck concentrically to the first end of the spindle. The connecting means includes a bell-shaped flange. A ball joint connects the support means to connecting means. A roller bellows is non-resilient in the circumferential direction and connects the support means to the bell-shaped flange. The roller bellows is arranged to form a joint chamber for sealing the space in which the ball joint is situated. A pressure fluid line is connected to the joint chamber. A pressure fluid cylinder-piston assembly is disposed coaxially with the spindle sleeve and the spindle sleeve is movable with the piston. The pressure fluid spaces of the joint chamber and of the pressure fluid cylinder-piston assembly are fluidly connected so as to be charged simultaneously with pressure fluid supplied to the fluid line.

Thus, there is provided a device for realizing an automatic change of workpiece and change of tool, in which the spindle sleeve is automatically adjusted and set and is held in the working position, with optimum compensation of the seating chuck.

According to a basic concept of this invention, the spindle sleeve is axially moved by a pressure cylinder-and-piston assembly actuated by pressure fluid which simultaneously actuates the seating chuck and brings the chuck into a position best suited for homokinetic compensation movements. In this manner all setting and adjustment movements can be exclusively and automatically controlled by the pressure fluid. Not only does this result in time savings, but also a uniformly high machining quality is obtained. Preferably compressed air is used as the pressurized fluid, but other gases and liquids may also be used.

The active surfaces of the piston and in the seating chuck may be designed for equilibrium between the axial forces acting in opposite directions in the working position.

The piston may be constructed as an annular piston fixed to the spindle sleeve. The cylinder may include first and second cylinder heads disposed at opposing ends of the cylinder. The first cylinder head having a pressure fluid chamber and an aperture adapted to receive the second end of the spindle sleeve. The second cylinder head having an aperture adapted to receive the first end of the spindle sleeve. The spindle sleeve being axially displacably but non-rotatably in the apertures of the first and second cylinder heads. The pressure fluid space bounded by the cylinder, the first cylinder head, and the outer surface of the spindle sleeve is connected to the pressure fluid chamber of the first head, which in turn is connected to the pressure fluid space of the joint chamber via a continuous axial bore disposed in the spindle sleeve.

The piston of the cylinder-piston assembly may be retracted according to a working cycle by application of a vacuum or reduced pressure to the pressure fluid space bounded by the cylinder, the first cylinder head, the outer surface of the spindle sleeve and the piston. The sub-pressure may be used to move the seating chuck into a position which favors an automatic change of the components to be changed.

The device may include a guide pin having first and second ends and a longitudinal bore. The guide pin being axially displaceably in the manner of a piston in the spindle sleeve axial bore. The guide pin first end extending into the joint chamber and being connected to the support means by the ball joint. The guide pin longitudinal bore being adapted to provide fluid communication between the spindle sleeve axial bore and the pressure fluid space of the joint chamber.

Other developments of the device include:

- a special construction of the components forming the ball joint and their mounting on the spindle sleeve;
- an advantageous form of construction of the guide pin carrying the ball head of the ball joint;
- a stop assembly for the guide pin with integrated valve apparatus for blocking the supply of pressurized fluid to the seating chuck when the guide pin is extended to the maximum; and
- an intermediate component for holding the lens which may be seated, locked and positioned, on the lens support of the seating chuck. The intermediate component facilitates automatic feeding and positioning of the components to be changed.

Other objects and advantages of the invention will become apparent upon reading the following detailed description and appended claims, and upon reference to the accompanying drawings.

BRIEF DESCRIPTION OF THE DRAWINGS

A preferred embodiment of the invention is described in more detail below with reference to the partly schematic drawings, in which

FIG. 5 shows a detail to a larger scale than FIG. 1 corresponding to the circle V in FIG. 1; and FIG. 6 shows a detail to a larger scale than FIG. 1 corresponding to the circle VI in FIG. 1.

DETAILED DESCRIPTION OF THE PREFERRED EMBODIMENT

Figure 1:
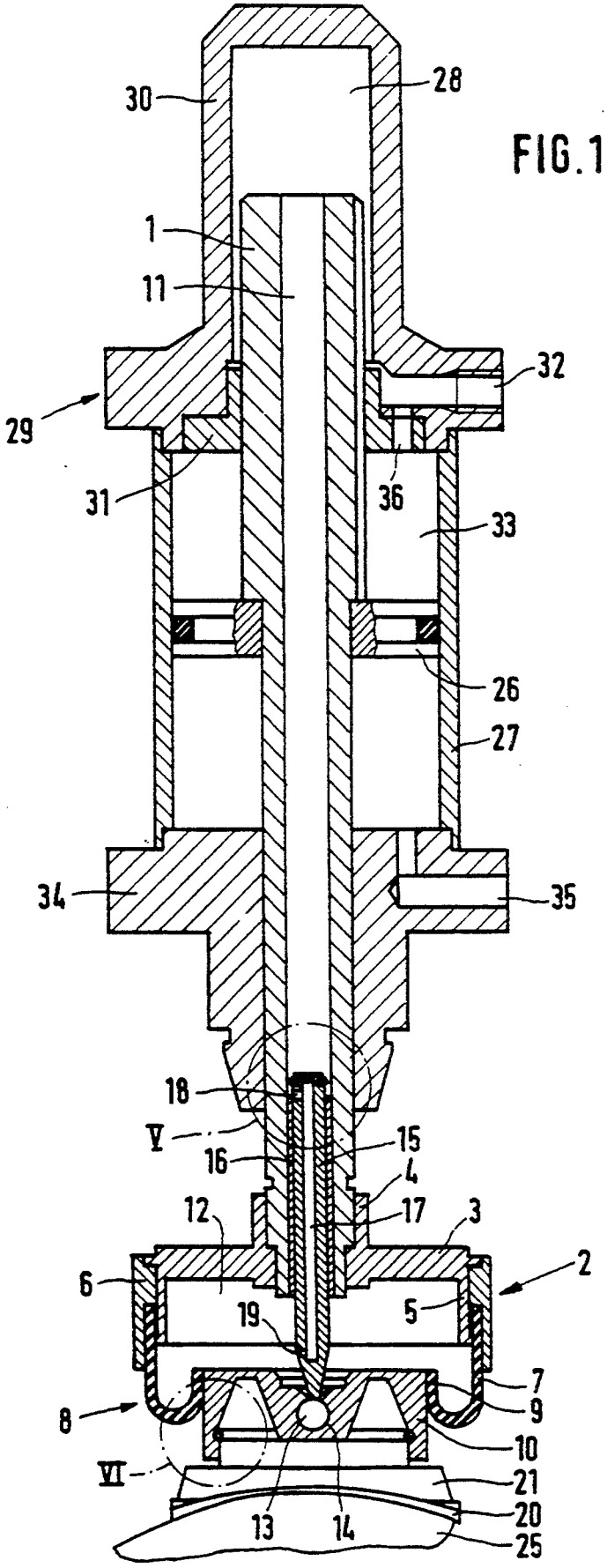
FIG. 1 shows, in longitudinal section, a device for machining toric lens surfaces, depicted in its working position.

The device shown in FIG. 1 is a component of a grinding or polishing machine, not illustrated, on which a plurality of the devices shown (for example two) can be mounted in parallel arrangement. Machines of this type are used for machining spectacle lens glass to prescription.

A rotationally symmetrical seating chuck 2 is fixed at the lower end of a spindle sleeve 1. The chuck 2 possesses a bell-shaped flange 3 having a concentric, hollow journal 4 and a circumferential wall 5. The chuck 2 is pushed onto the lower end of the spindle sleeve 1 and fixed there in a suitable manner so that it cannot be rotated nor axially displaced relative to the sleeve. An outer ring 6 is fixed to the flange 3 and is concentric with the circumferential wall 5. A roller bellows 8 has an outer wall 7 firmly and sealingly clamped between the circumferential wall 5 and the outer ring 6. The inner wall 9 of the roller bellows 8 is sealingly fixed to the cylindrical peripheral surface of a lens support 10.

The roller bellows 8 is constructed of an elastomeric material with an incorporated reinforcement inlay, which does not prevent bending of the roller bellows but does prevent its elastic straining. The roller bellows 8 can execute rolling movements without being strained and is non-resilient in the circumferential direction. Rotations of the lens support 10 relative to the flange 3 therefore cannot occur during machining operation.

A ball joint is disposed in a sealed joint chamber 12 formed by the roller bellows 8, the flange 3 and the lens support 10. The ball joint is in the form a ball end 13 which engages into a ball socket 14. The ball end 13 is situated on the free end of a guide pin 15 and the ball socket 14 is situated in the lens support 10. The guide pin 15 is positioned in a guide bushing 16 inserted inside the axial bore 11 extending through the length of the spindle sleeve 1. The guide pin 15 is axially slidably in the manner of a piston inside guide bushing 16 and hence the axial bore 11. The guide pin 15 includes a longitudinal bore 17, closed at both ends, which is in fluid communication via an upper transverse bore 18 with the axial bore 11 and by a lower transverse bore 19 with the joint chamber 12.

The seating chuck 2 with its ball joint 13, 14 and the roller bellows 8 constitutes, on account of the non-resilience of the roller bellows in the circumferential direction, a play-free homokinetic coupling between the lens support 10 and the flange 3. Because the roller bellows 8 is non-resilient in the circumferential direction, it does not impede the tilting capability of the lens support 10 about the ball joint 13, 14 relative to the flange 3. Therefore tilting compensating movements of the lens support 10 are possible without limitation. Furthermore, the roller bellows 8 hermetically seals the ball joint 13, 14 from the abrasive polishing and grinding agents.

For machining toric lenses, the lens support 10 is releasably locked to an intermediate component 21, mounted concentrically thereto and holding the lens 20. The intermediate component 21 rests upon the grinding or polishing tool 25 and the lens 20 to be machined is situated between them and is fixed to the intermediate component 21. As FIGS. 1 to 4 indicate, an engaged or locked position in which the intermediate component 21 engages form-fittingly and positioningly into the lens support 10. The two components are releasably locked together by a locking mechanism. For this purpose, as can be seen most clearly from FIG. 6, a circumferential internal groove 22 is provided on a lower cylindrical wall of the lens support 10 and a circumferential outer groove 23 is provided on a complementary cylindrical wall of the intermediate component 21. An O-ring 24 positioned in the circumferential groove 22, 23 serves as the locking mechanism between the intermediate component 21 and the lens support 10.

The spindle sleeve 1 is adapted to be moved axially by the pressure cylinder-and-piston assembly disposed coaxially thereto. The piston 26 is constructed as an annular piston, fixed to the spindle sleeve 1, which together with the spindle sleeve 1, acting as a piston rod, can be displaced inside the cylinder 27. The cylinder 27 is closed at one end by an upper cylinder head 29 having a pressurized fluid chamber 28. The pressurized fluid chamber 28 is situated inside a beaker-shaped extension 30 of the cylinder head 29. The spindle sleeve 1, with its upper end into the pressure fluid chamber 28, is axially displaceably but non-rotatably in the upper cylinder head 29. For this purpose, a guide ring 31 is fixed, axially and rotatably immovable, inside the upper cylinder head 29. The spindle sleeve 1 passes through the guide ring 31 and is non-rotatably keyed to it by spline elements or the like disposed on the spindle sleeve 1 above the piston 26 and the corresponding through bore of the guide ring 31.

In the upper cylinder head 29 there is a connecting bore 32 for the optional feed of the pressurized fluid or for the application of a vacuum. The connecting bore 32 is permanently in communication both with the pressure fluid chamber 28 and also with a pressure fluid space 33. The pressure fluid space 33 is bounded by the cylinder 27, the upper cylinder head 29, the outer surface of the spindle sleeve 1 and the piston 26. No seal is required between the spindle sleeve 1 and the upper cylinder head 29 or guide ring 31 because no pressure difference between the pressure fluid chamber 28 and the pressure fluid space 33. As a result, the spindle sleeve 1 passes with low friction through the guide ring 31.

A lower cylinder head 34 closes the bottom end of the cylinder 27. The spindle sleeve 1 is axially slidably guided, by its end carrying the seating chuck, through the lower cylinder head 34. Here again, a seal which would increase friction is not necessary between the lower cylinder head 34 and the spindle sleeve 1 because no pressurized fluid is supplied to the cylinder space between the piston 26 and the lower cylinder head 34. Rather this space is in permanent communication with the external atmosphere via a venting opening 35 passing through the lower cylinder head 34. The two cylinder heads 29 and 34 and the cylinder 27 are firmly held together by suitable means. The entire device may, for example, be fixed by means of the lower cylinder head 34 to a cross-member or the like of the grinding and polishing machine (not illustrated), which is movably driven according to the kinematic requirements for machining toric surfaces.

The pressure fluid space of the joint chamber 12 and the pressure fluid space 33 of the pressure fluid cylinder piston assembly 26, 27 are in fluid communication with one another and both are also in fluid communication with the connecting bore 32.

Pressure fluid supplied through the connecting bore 32 passes via a feed bore 36 in the upper cylinder head 29 and guide ring 31, into the pressure fluid space 33. At the same time, pressure fluid at the same pressure passes from the connecting bore 32 into the joint chamber 12. More specifically, pressure from the connecting bore passes into the pressure fluid chamber 28 and then, via the axial bore 11 in the spindle sleeve 1 and via the bores 18, 17 and 19 in the guide pin 15, into the pressure fluid space of the joint chamber 12. The pressure fluid space of the joint chamber 12 and the pressure fluid space 33, situated above the piston 26, are therefore simultaneously loaded with the pressure fluid.

Figure 4:
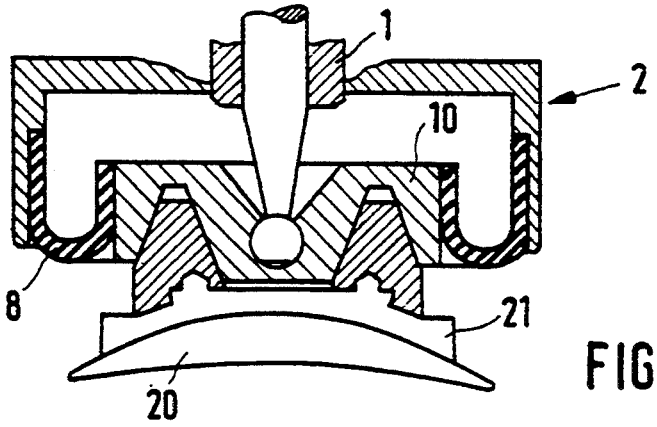
FIG. 4 shows a section through the seating chuck in inflated condition best suited for balancing movements.

For the functioning of the device it is essential that, in the working position of the device illustrated in FIG. 1, a defined force balance or force equilibrium shall be present. For this purpose the dimensions of the pressure fluid active surfaces on the piston 26, including the annular end surface of the spindle sleeve 1 situated in the pressure fluid chamber 28, and the pressure fluid active surfaces in the seating chuck 2, are designed for equilibrium between the axially active forces orientated in opposite directions in the working position. In the ideal condition, the spindle sleeve 1 and seating chuck 2 adopt approximately the position shown in FIG. 1, in which the aforementioned force balance is present and an application force sufficient for the intended machining operation is applied between workpiece and tool. FIGS. 1 & 4 illustrate the cross-section configuration of the roller bellows 8 when device operating at proper fluid pressure. In particular, the U-shaped transition between the outer wall 7 and inner wall 9 of the roller bellows 8, should be symmetrical with respect to an imaginary center line between the walls 7 and 9. This working position of the roller bellows 8 ensures optimum homokinetic compensation movements between the flange 3 and the lens support 10 of the seating chuck 2.

Figure 2:
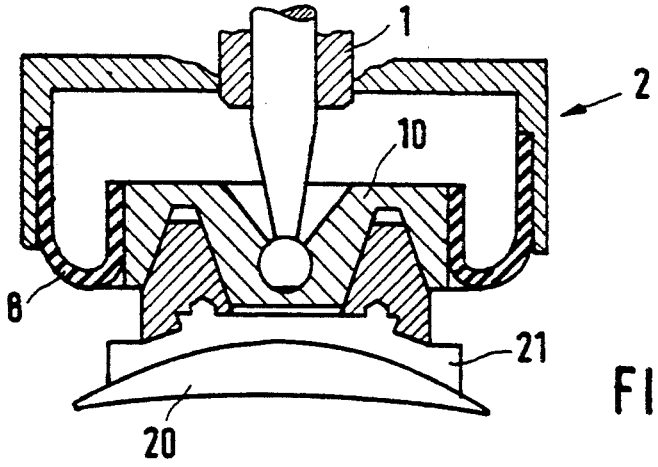
FIG. 2 shows a section through the seating chuck, in a condition too highly inflated for balancing movements.
Figure 3:
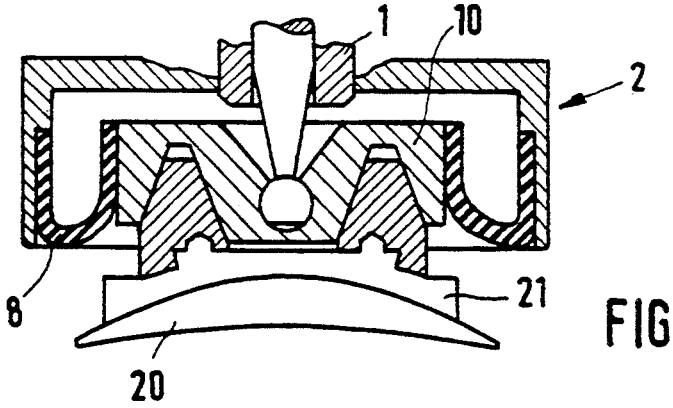
FIG. 3 shows a section through the seating chuck in a condition too weakly inflated for balancing movements.

FIGS. 2 & 3 illustrate the cross-section configuration of the roller bellow 8 when the device is operating at an improper pressure. In FIG. 2, the pressurized fluid loading of the seating chuck 2 is too high and in FIG. 3 the pressure is too low. In both cases this results in a tightening of the roller bellows 8 which adversely affects the tilting capability of the roller bellows.

The guide pin 15 also possesses a special feature illustrated in FIG. 5. When it is loaded at its end by the pressurized fluid, its outwardly directed displacement travel is limited by a stop. For this purpose, an O-ring 37 is seated in a circumferential groove located at the upper end of the guide pin 15. The O-ring 37 limits the maximum extension of the guide pin by striking against the end face 38 of the guide bush 16. This arrangement also acts as a valve device. At the maximum extension of the guide pin 15, the upper transverse bore 18 is completely covered by the guide bush 16 and the O-ring 37 bears sealingly against the end face 38, thereby interrupting the connection between the axial bore 11 of the spindle sleeve 1 and the longitudinal bore 17. In this position, pressurized fluid cannot flow into the pressurized fluid space of the joint chamber 12, so that an excessive forward travel of the roller bellows 8 and of the movable internal components fixed to it is prevented.

Operation of the device will now be explained by way of example. The device is brought into the working position by supplying pressurized fluid to the connecting bore 32. The pressure fluid flows through the connecting bore 32 into the pressure fluid space 33, the pressure fluid chamber 28 and, via the bores described, into the pressure fluid space of the joint chamber 12. As a consequence, the roller bellows 8 together with the lens support 10 and the intermediate piece 21 holding the lens 20 is moved downwards in the seating chuck 2. The above-described stop assembly at the upper end of the guide pin 15 prevent an excessive forward travel. At the same time, the piston 26 together with the spindle sleeve 1 travels out until the workpiece, that is the lens 20, is pressed against the tool to the extent necessary for machining. In this working position, the described force equilibrium automatically becomes established. When the roller bellows 8 is in the configuration shown in FIGS. 1 and 4 it permits the compensating movements necessary in machining. Working pressures of the pressure fluid between 0.1 and 1.0 bar are sufficient for all applications. In the case of plastics glasses, the working pressure is between about 0.2 to 0.4 bar, whereas in the case of mineral glasses working pressures of up to 1.0 bar may be necessary. The minimum working pressure required to overcome the internal friction of the device is about 0.1 bar.

After the grinding or polishing operation is completed, the device is brought back into its starting position. This is accomplished by application of suction via the connecting bore 32 to the pressure fluid space 33 to return the spindle sleeve to its feed and starting position. The lens support 10 together with intermediate piece 21 and the machined lens 20 situated thereon is thus lifted off the tool 25. Since the suction applied through the described bores and chambers also comes into action in the pressure fluid space of the joint chamber 12. Hence, the membrane composed of the roller bellows 8 and the lens support 10 is simultaneously pulled, together with the intermediate piece 21 and the lens 20, into abutment in the bell-shaped flange 3. In this way the accurate positioning of the workpiece and components carrying the workpiece, necessary for an automatic feed, is obtained. The releasable locked engagement between lens support 10 and intermediate component 21 makes it possible for the components to be rapidly changed and/or adjusted. Moreover, because the intermediate piece 21 is releasably locked to the lens support 10, reliable separation of the lens 20 from the tool 25 is achieved at the end of machining.

Within the scope of the present invention, it is also possible, when the working position is reached, to fix the relative position of spindle sleeve 1 and cylinder 27 in the axial direction. In this case, axial compensating movements of the seating chuck 2 would have to be undertaken.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

I claim:

1. A device for guiding a workpiece or tool in the machining of toric or spherical surfaces of optical lenses on grinding or polishing machines, comprising:

an axially movable spindle sleeve disposed on the grinding or polishing machine and having first and second ends;

a seating chuck having support means for supporting one of a lens and a tool;

connecting means for fitting the chuck concentrically to the first end of the spindle sleeve, the connecting means having a bell-shaped flange;

a ball joint connecting the support means to connecting means;

a roller bellows being non-resilient in the circumferential direction and connecting the support means to the bell-shaped flange, the roller bellows being arranged to form a joint chamber for sealing the space in which the ball joint is situated;

a pressure fluid line connected to the joint chamber;

a pressure fluid cylinder-piston assembly disposed coaxially with the spindle sleeve, the spindle sleeve being movable with said piston, and the pressure fluid spaces of the joint chamber and of the pressure fluid cylinder-piston assembly being fluidly connected so as to be charged simultaneously with pressure fluid supplied to said fluid line.

2. A device according to claim 1, wherein the pressure fluid active surfaces on the piston and in the seating chuck are designed for equilibrium between the axial forces acting in opposite directions in the working position.

3. A device according to claim 1, wherein:

the piston is an annular piston fixed to the spindle sleeve;

first and second cylinder heads disposed at opposing ends of the cylinder, the first cylinder head having a pressure fluid chamber and an aperture adapted to receive the second end of the spindle sleeve, the second cylinder head having an aperture adapted to receive the first end of the spindle sleeve, the spindle sleeve being axially displaceably but nonrotatably in the apertures of the first and second cylinder heads; and the pressure fluid space bounded by the cylinder, the first cylinder head, and the outer surface of the spindle sleeve is connected to the pressure fluid chamber of the first head, which in turn is connected to the pressure fluid space of the joint chamber by way of a continuous axial bore disposed in the spindle sleeve.

4. A device according to claim 3, wherein spindle sleeve is movable to a feed starting position by application of a vacuum or reduced pressure to the said pressure fluid space bounded by the cylinder, the first cylinder head, the outer surface of the spindle sleeve and the piston.

5. A device according to claim 3, further including a guide pin having first and second ends and a longitudinal bore, the guide pin being axially displaceably in the manner of a piston in the spindle sleeve axial bore, the guide pin first end extending into the joint chamber and being connected to the support means by the ball joint, the guide pin longitudinal bore being adapted to provide fluid communication between the spindle sleeve axial bore and the pressure fluid space of the joint chamber.

6. A device according to claim 5, wherein the guide pin longitudinal bore is closed at the first and second ends and traverse bores disposed at guide pin first and second ends intercept the longitudinal bore, thereby providing a fluid connection between the spindle sleeve axial bore and the pressure fluid space of the joint chamber.

7. A device according to claim 5, further including:

a stop means for limiting the maximum outwardly orientated displacement of the guide pin; and a valve adapted to interrupt the fluid connection between the spindle sleeve axial bore and the longitudinal bore of the guide pin when guide pin extended to its maximum displacement.

8. A device according to claim 7, further including a guide bushing disposed in the spindle sleeve axial bore at the first end of the spindle sleeve, the bushing having an end face positioned inside the spindle sleeve axial bore, the guide pin being axial displacable in the bushing and the guide pin second end extending through the bushing and into the spindle sleeve axial bore; and wherein the stop means comprises an O-ring positioned on the guide pin second end and adapted to bear against the end face of the bushing, thereby limiting the maximum displacement guide pin.

9. A device according to claim 8, wherein the valve comprises the end face of the bushing in combination with the O-ring.

10. A device according to claim 1, wherein the support means includes:

a lens support connected to the ball joint and the roller bellows;

an intermediate component being adapted to hold a lens; and means for concentrically mounting and releasably connected the intermediate component to the lens support.

11. A device according to claim 10, wherein the lens support includes a circumferential inner groove and the intermediate component includes a circumferential outer groove, and an O-ring is seated in the grooves and being adapted to releasably the intermediate means to the support means.

12. A device according to claim 3, in which the spindle sleeve can be axially secured relative to the cylinder.

13. A device according to claim, 5, wherein spindle sleeve is movable to a feed starting position by application of a vacuum or reduced pressure to the pressure fluid space bounded by the cylinder, the first cylinder head, the outer surface of the spindle sleeve and the piston.

14. A device according to claim 1, wherein spindle sleeve is movable to a feed starting position by application of a vacuum or reduced pressure to the said pressure fluid space bounded by the cylinder, the first cylinder head, the outer surface of the spindle sleeve and the piston.

15. A device according to claim 1, in which the spindle sleeve can be axially secured relative to the cylinder.

16. A device for guiding a workpiece or tool in the machining of toric or spherical surfaces of optical lenses on grinding or polishing-machines, comprising:

a pressure fluid cylinder-piston assembly disposed on the grinding or polishing machine, the pressure fluid cylinder-piston assembly having a cylinder, a piston movable in said cylinder, and a pressure fluid space adapted to receive pressurized fluid for controlling movement of the piston within the cylinder;

an axially movable spindle sleeve and having first and second ends and an axial bore extending between the first and second ends, the spindle sleeve being mounted coaxially with the piston for movement therewith, the axial bore being in fluid communication with the pressure fluid space;

a bell-shaped flange fixed coaxially to the spindle sleeve first end;

support means for supporting one of a lens and a tool;

a ball joint connecting the support means to the spindle sleeve first end;

a roller bellows being non-resilient in the circumferential direction and connecting the support means to the bell-shaped flange, the roller bellows the support means and the bell-shaped flange forming a sealed joint chamber in which the ball joint is situated; and means for providing fluid communication between the pressure fluid space of the cylinder-piston assembly and the joint chamber so that the joint chamber and the pressure fluid space are charged simultaneously when pressure fluid is supplied to the pressure fluid space.

17. A device for guiding a workpiece or tool in the machining of toric or spherical surfaces of optical lenses on grinding or polishing machines, comprising:

a pressure fluid cylinder-piston assembly disposed on the grinding or polishing machine, the pressure fluid cylinder-piston assembly having a cylinder, a piston movable in said cylinder, and a pressure fluid space adapted to receive pressurized fluid for controlling movement of the piston within the cylinder;

an axially movable spindle sleeve having first and second ends and an axial bore extending between the first and second ends, the spindle sleeve being mounted coaxially with the piston for movement therewith, the axial bore being in fluid communication with the pressure fluid space;

a bell-shaped flange fixed coaxially to the spindle sleeve first end;

support means for supporting one of a lens and a tool;

a roller bellows being non-resilient in the circumferential direction and connecting the support means to the bell shaped flange, the roller bellows the support means, and the bell-shaped flange forming a sealed joint chamber;

a guide pin having first and second ends and a longitudinal bore, the guide pin being axially displaceably in the manner of a piston in the spindle sleeve axial bore, the guide pin first end extending into the joint chamber, the guide pin longitudinal bore being adapted to provide fluid communication between the spindle sleeve axial bore the joint chamber;

a ball joint connecting the guide pin first end to the support means, the ball joint being situated in the joint chamber; and wherein, joint chamber and the pressure fluid space of the cylinder-piston assembly are fluidly connected so as to be charged simultaneously when pressure fluid is supplied to the pressure fluid space.

* * * * *